US012279738B2

(12) United States Patent
Kim et al.

(10) Patent No.: US 12,279,738 B2
(45) Date of Patent: Apr. 22, 2025

(54) SHOE CARE APPARATUS

(71) Applicant: Samsung Electronics Co., Ltd., Suwon-si (KR)

(72) Inventors: Daegeon Kim, Suwon-si (KR); Jinyounggeul Oh, Suwon-si (KR); Sejin Yun, Suwon-si (KR); Kanghyun Lee, Suwon-si (KR); Dongpil Seo, Suwon-si (KR); Junghee Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 486 days.

(21) Appl. No.: 17/734,151

(22) Filed: May 2, 2022

(65) Prior Publication Data

US 2022/0354340 A1 Nov. 10, 2022

Related U.S. Application Data

(63) Continuation of application No. PCT/KR2022/003886, filed on Mar. 22, 2022.

(30) Foreign Application Priority Data

May 4, 2021 (KR) ..... 10-2021-0057892
Jul. 23, 2021 (KR) ..... 10-2021-0096977

(51) Int. Cl.
*A47L 23/20* (2006.01)
*A47B 61/04* (2006.01)
*A47L 23/18* (2006.01)

(52) U.S. Cl.
CPC ..... *A47L 23/20* (2013.01); *A47B 61/04* (2013.01); *A47L 23/18* (2013.01)

(58) Field of Classification Search
CPC ..... A47L 23/18; A47L 23/20; A47B 61/04; D06F 58/10; F25D 23/02; F25D 23/028; F26B 3/04; F26B 21/00; F26B 21/04
See application file for complete search history.

(56) References Cited

U.S. PATENT DOCUMENTS 9,074,405 B2 7/2015 Shim et al.
9,091,476 B2 7/2015 Kim et al.
(Continued)

FOREIGN PATENT DOCUMENTS

CN 105831995 A 8/2016
JP 2013-257138 A 12/2013
(Continued)

OTHER PUBLICATIONS

International Search Report dated Jun. 30, 2022 in connection with International Patent Application No. PCT/KR2022/003886, 4 pages.
(Continued)

*Primary Examiner* — Randall E Chin

(57) ABSTRACT

Provided is a shoe care apparatus including a door capable of simplifying an assembly process while reducing material cost. The shoe care apparatus includes: a main body; a care room provided inside the main body and accommodating shoes; and a door opening and closing the care room, wherein the door includes: a front panel forming a front surface of the door, and including a side trim provided on a rear surface of the front panel or a magnet provided on the rear surface of the front panel; a rear body forming a rear surface of the door; and a reinforcement plate positioned between the front panel and the rear body, and detachably coupled with the front panel, and the reinforcement plate includes: a recess portion accommodating at least one portion of the side trim; and a magnet coupling portion coupled
(Continued)

with the magnet by a magnetic force of the magnet, and arranged in parallel to the recess portion.

14 Claims, 11 Drawing Sheets

(56) References Cited

U.S. PATENT DOCUMENTS

| | | | |
|---|---|---|---|
| 11,287,174 | B2 | 3/2022 | Lee et al. |
| 11,319,664 | B2 | 5/2022 | Chang et al. |
| 11,408,679 | B2 | 8/2022 | Ohnari et al. |
| 2021/0324566 | A1 | 10/2021 | Oak et al. |
| 2021/0396458 | A1 | 12/2021 | Moon et al. |
| 2022/0136164 | A1 | 5/2022 | Kweon et al. |
| 2023/0081091 | A1 | 3/2023 | Kim et al. |

FOREIGN PATENT DOCUMENTS

| | | | | |
|---|---|---|---|---|
| JP | 2021-040909 | A | 3/2021 | |
| KR | 10-1999-0005699 | A | 1/1999 | |
| KR | 20-0146676 | Y1 | 6/1999 | |
| KR | 10-2014-0060431 | A | 5/2014 | |
| KR | 10-1668707 | B1 | 10/2016 | |
| KR | 10-2020-0021359 | A | 2/2020 | |
| KR | 10-2020-0030404 | A | 3/2020 | |
| KR | 10-2020-0133309 | A | 11/2020 | |
| KR | 10-2021-0009689 | A | 1/2021 | |
| KR | 10-2021-0017015 | A | 2/2021 | |
| KR | 10-2021-0085188 | A | 7/2021 | |
| KR | 10-2021-0112770 | A | 9/2021 | |
| KR | 10-2021-0156166 | A | 12/2021 | |
| WO | WO-2018003548 | A1 * | 1/2018 | ..... F25D 23/02 |

OTHER PUBLICATIONS

Supplementary European Search Report dated Apr. 2, 2024, in connection with European Application No. 22798994.4, 7 pages.

Communication under Rule 71(3) EPC dated Dec. 19, 2024, in connection with European Application No. 22798994.4, 50 pages.

* cited by examiner

SHOE CARE APPARATUS

CROSS-REFERENCE TO RELATED APPLICATIONS

This application is a continuation of International Application No. PCT/KR2022/003886 filed on Mar. 22, 2022, which is based on and claims priority under 35 U.S.C. § 119 to Korean Patent Provisional Application No. 10-2021-0057892 filed on May 4, 2021, and Korean Patent Application No. 10-2021-0096977 filed on Jul. 23, 2021, in the Korean Intellectual Property Office, the disclosures of which are incorporated by reference herein in their entirety.

BACKGROUND

1. Field

The disclosure relates to a shoe care apparatus, and more particularly, to a shoe care apparatus with an improved door structure.

2. Description of the Related Art

A shoe care apparatus is an apparatus for maintaining shoes by drying the shoes, keeping the shoes clean, or deodorizing the shoes.

The shoe care apparatus includes a cabinet, a care room provided inside the cabinet for accommodating shoes, and a door coupled with the cabinet to open and close the care room.

The door should have sufficient stiffness such that it is not deformed during a use process. Although there are various methods for reinforcing the stiffness of the door, a method for simplifying an assembly process while reducing material cost is described herein.

SUMMARY

Therefore, it is an aspect of the disclosure to provide a shoe care apparatus including a door capable of simplifying an assembly process while reducing material cost.

It is another aspect of the disclosure to provide a shoe care apparatus capable of easily changing a design of a door.

It is still another aspect of the disclosure to provide a shoe care apparatus including a door implemented by coupling a rear body provided as an injection mold with a cover plate provided as a metal material by using a rivet.

Additional aspects of the disclosure will be set forth in part in the description which follows and, in part, will be obvious from the description, or may be learned by practice of the disclosure.

In accordance with a concept of the disclosure, a shoe care apparatus includes: a main body; a care room provided inside the main body and accommodating shoes; and a door opening and closing the care room, wherein the door includes: a front panel forming a front surface of the door, and including a side trim provided on a rear surface of the front panel or a magnet provided on the rear surface of the front panel; a rear body forming a rear surface of the door; and a reinforcement plate positioned between the front panel and the rear body, and detachably coupled with the front panel, and the reinforcement plate includes: a recess portion accommodating at least one portion of the side trim; and a magnet coupling portion coupled with the magnet by a magnetic force of the magnet, and arranged in parallel to the recess portion.

The door may include: a first door cover including the side trim and a first front panel including a first material; or a second door cover including the magnet and a second front panel including a second material that is different from the first material.

The door may include a bracket positioned between the reinforcement plate and the rear body, and coupled with the rear body and the reinforcement plate to couple the reinforcement plate with the rear body.

The reinforcement plate may be coupled with the rear body by a first coupling member.

The bracket may be coupled with the rear body by a second coupling member which is different from the first coupling member.

At least one of the first coupling member and the second coupling member may include a rivet.

The rear body may further include a rivet coupling portion with which the rivet is coupled, wherein the rivet coupling portion and the rear body are integrated into one body.

The rivet coupling portion may include: a rivet hole through which the rivet passes; and a rivet support plate in which the rivet hole is formed, the rivet support plate facing the reinforcement plate.

The rivet coupling portion may further include an accommodating space accommodating the rivet passed through the rivet hole.

One side of the accommodating space may open.

The recess portion may include a coupling groove in which at least one portion of the side trim is inserted.

The side trim may be coupled with the recess portion by being inserted in the coupling groove.

The side trim may include a pair of side trims.

The magnet may include a pair of magnets.

The recess portion may include a pair of recess portions accommodating at least one portion of each of the pair of side trims.

The magnet coupling portion may include a pair of magnet coupling portions coupled with the pair of magnets by a magnetic force.

The pair of magnet coupling portions may be positioned between the pair of recess portions.

The door may further include: a control panel embedded into an upper portion of the door; a wire extending from the control panel to inside of the main body; and a wire guide guiding the wire and covering a portion of the wire such that the wire passes a hinge of the door and extends to the inside of the main body.

The wire guide may include: a wire entrance formed at one side of the wire guide such that the wire extending from the control panel enters inside of the wire guide; and a wire exit formed at the other side of the wire guide such that the wire entered the inside of the wire guide extends to the inside of the main body.

The shoe care apparatus may further include: a supply duct supplying outside air of the care room to the care room; a shoe supporter configured to support shoes, connected to the supply duct, and supplying inside air of the supply duct to the shoes; and a supporter holder supporting the shoe supporter disconnected from the supply duct, and positioned on a rear surface of the door body.

According to a concept of the disclosure, a shoe care apparatus includes: a main body; a care room provided inside the main body and accommodating shoes; and a door opening and closing the care room, wherein the door includes: a rear body forming a rear surface of the door; a front panel forming a front surface of the door; and a reinforcement plate positioned between the rear body and the front panel, and detachably coupled with the front panel, the front panel includes a pair of side trims or a pair of magnets coupled with the reinforcement plate and protruding backward from the front panel, the reinforcement plate includes a pair of recess portions each accommodating at least one portion of each of the pair of side trims and a pair of magnet coupling portions respectively coupled with the pair of magnets by a magnetic force, and the pair of magnet coupling portions are positioned between the pair of recess portions.

The shoe care apparatus may further include a control panel embedded into an upper portion of the door, and a user interface of the control panel may be provided on an upper surface of the door.

The shoe care apparatus may further include a door hinge rotatably coupling the door with the main body, and a wire guide guiding a wire for supplying power to the control panel to extend toward the door hinge.

An accessory storage portion may be provided on a door body in such a way as to protrude toward the care room upon closing of the door.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
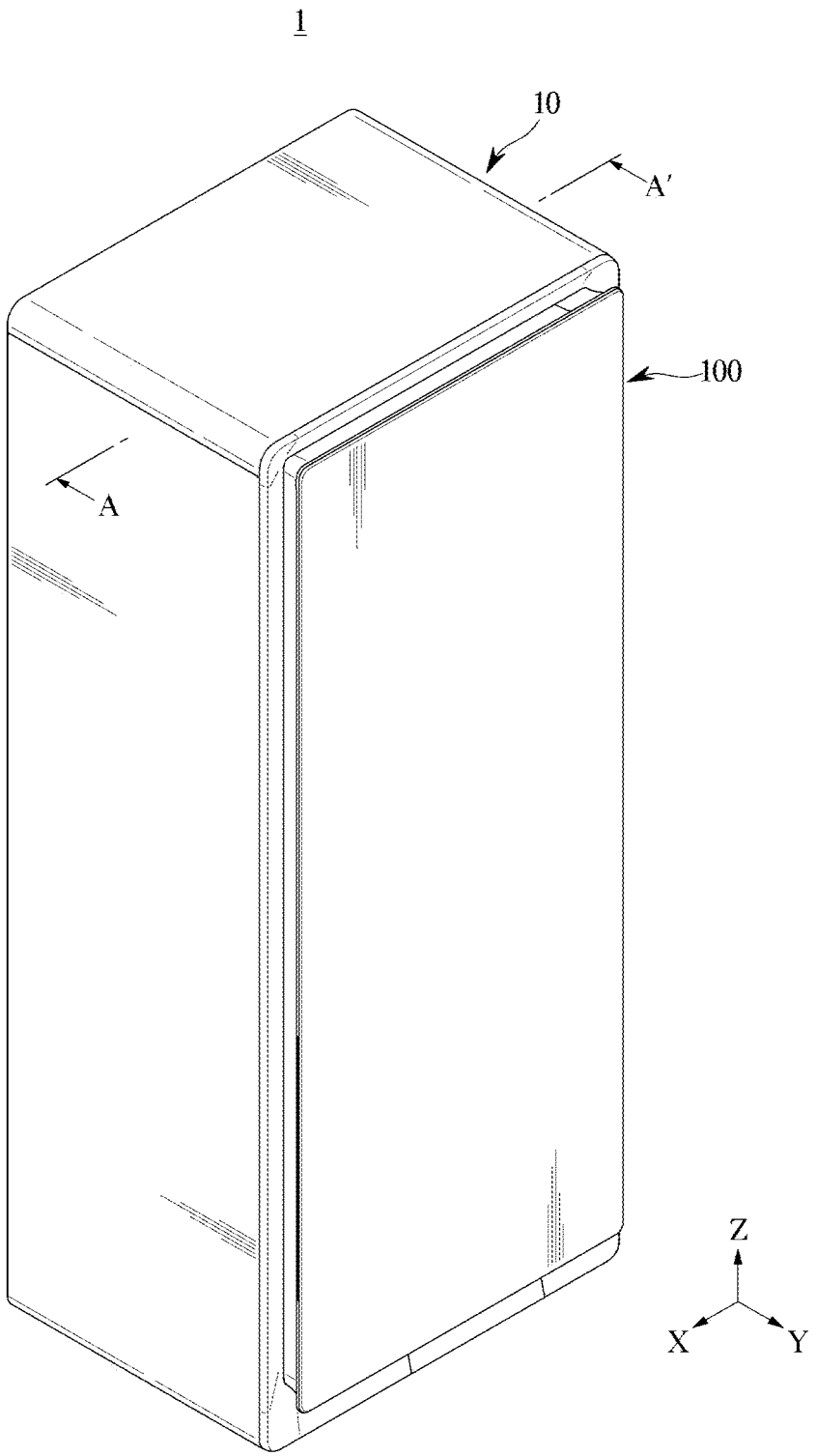
FIG. 1 illustrates a shoe care apparatus according to an embodiment of the disclosure.

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are merely used to describe embodiments, and are not intended to restrict and/or limit the disclosure. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

It will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the disclosure. As used herein, the term "and/or" includes any and all combinations of one or more of associated listed items.

In the following description, the terms "front", "rear", "left", "right", etc. are defined based on the drawings, and the shapes and positions of the corresponding components are not limited by the terms.

Throughout the disclosure, the expression "at least one of a, b or c" indicates only a, only b, only c, both a and b, both a and c, both b and c, all of a, b, and c, or variations thereof.

Hereinafter, embodiments of the disclosure will be described in detail with reference to the accompanying drawings.

Figure 2:
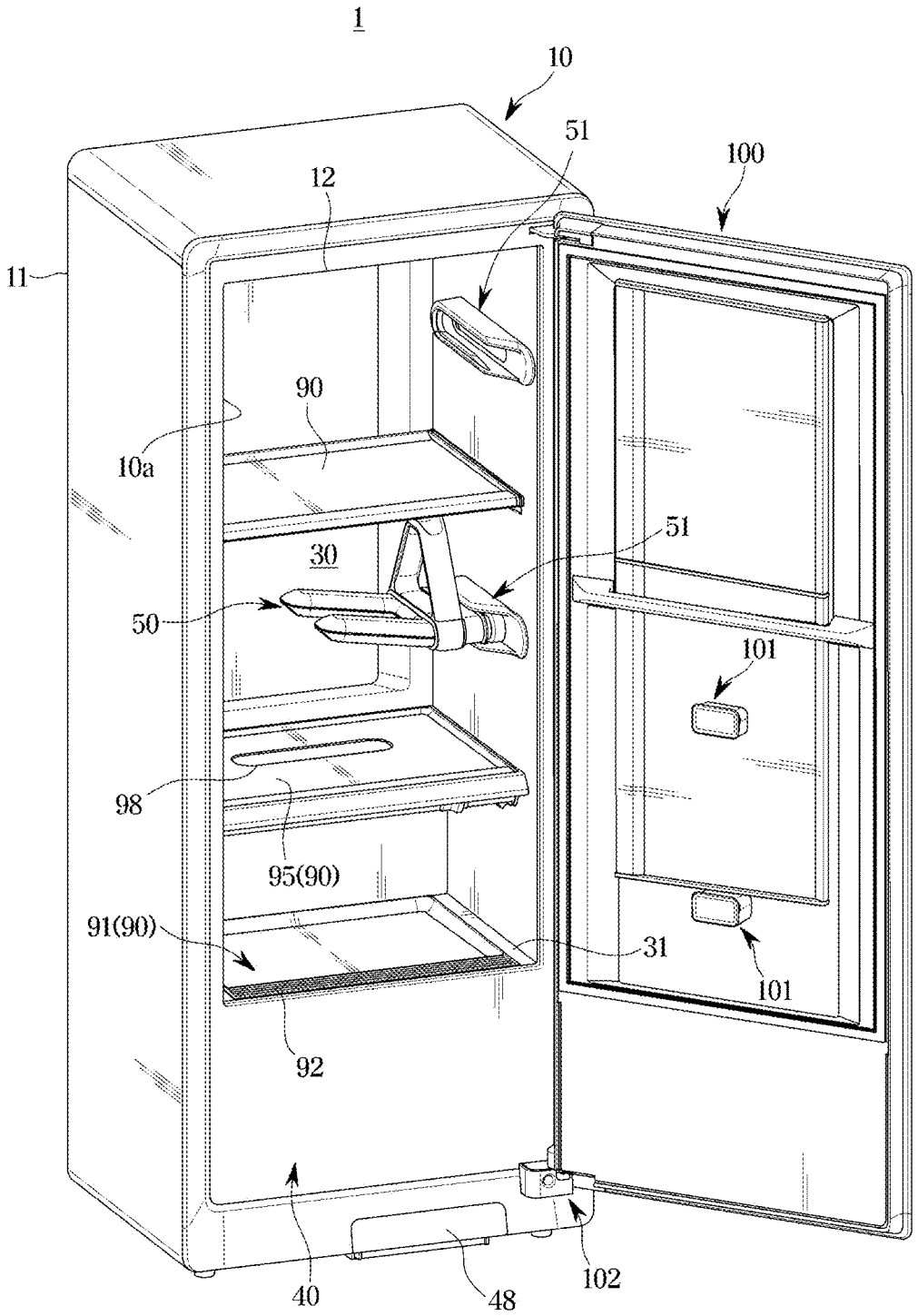
FIG. 2 illustrates a door open state of the shoe care apparatus shown in FIG. 1.
Figure 3:
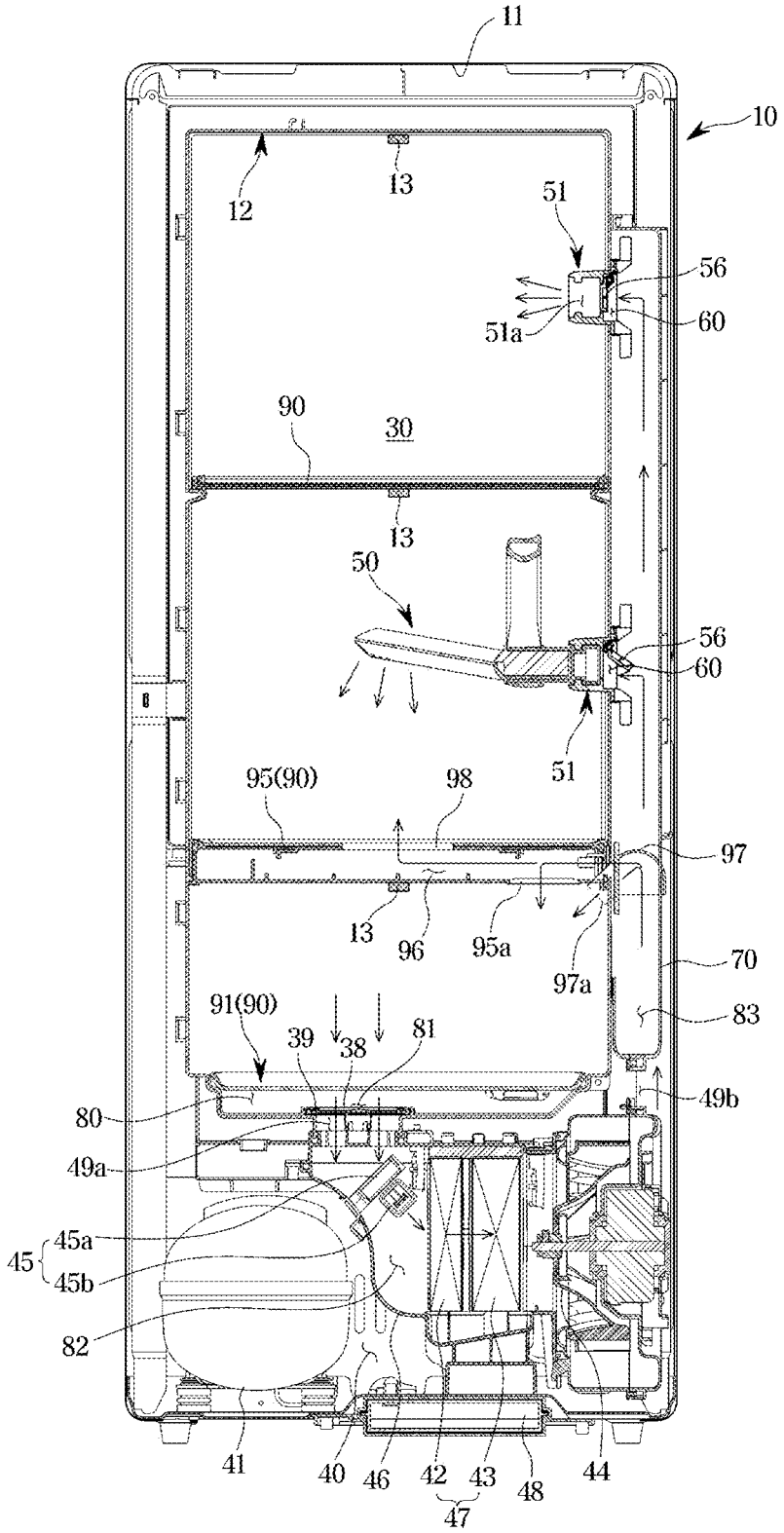
FIG. 3 illustrates a cross-sectional view taken along line A-A' of FIG. 1.

FIG. 1 illustrates a shoe care apparatus according to an embodiment of the disclosure. FIG. 2 illustrates a door open state of the shoe care apparatus shown in FIG. 1. FIG. 3 illustrates a cross-sectional view taken along line A-A' of FIG. 1.

In the present specification, a main body may indicate a cabinet.

Referring to FIG. 1, the X-axis direction may be defined as a left-right direction, the Y-axis direction may be defined as a front-back direction, and the Z-axis direction may be defined as an up-down direction.

Referring to FIGS. 1 to 3, a shoe care apparatus 1 according to an embodiment of the disclosure may include a cabinet 10, and a door 100 rotatably coupled with the cabinet 10.

The cabinet 10 may be in a shape of a rectangular parallelepiped of which the front side opens. In the open front side of the cabinet 10, a cabinet opening 10*a* may be formed. The door 100 may be rotatably coupled with the cabinet 10 to open and close a care room 30 formed in the cabinet 10. The door 100 may be coupled with the cabinet 10 through a hinge 102.

The door 100 may include a support holder 101 provided on one side facing the inside of the care room 30 upon closing of the care room 30. At least one support holder 101 may be provided. The support holder 101 may easily hold a shoe supporter 50 which will be described below by hanging the shoe supporter 50 thereon. However, a use of the supporter holder 101 is not limited to this, and the supporter holder 101 may be used to hold other components. In the present specification, the supporter holder 101 may be an example of an accessory storage portion. The accessory storage portion may be provided on a door body 120 in such a way as to protrude toward the care room 30 upon closing of the door 100.

The door 100 may further include a user interface such as an inputter (not shown) provided on an upper surface of the door 100. A user may set various care courses through the inputter based on a kind of shoes that he/she wants to care. The inputter may include a control panel capable of receiving touch inputs, or a button capable of receiving physical pressure inputs. A control panel 170 may display a progress state of a care course, state information (shoes, clothes, etc.) of an accommodated object, etc. At least one portion of the upper surface of the door 100 may be made of a transparent material. Accordingly, a user interface of the control panel 170 embedded into an upper portion of the door 100 may be displayed on the upper surface of the door 100. Also, the control panel 170 may display state information, etc. of smell sensed by a sensor 13. Accordingly, a user may easily check state information of the shoe care apparatus 1 through the control panel 170 without opening the door 100.

The cabinet 10 may include an external case 11 forming an outer appearance, and an internal case 12 installed inside the external case 11. The internal case 12 may form the care room 30. The care room 30 may accommodate a plurality of shoes, clothes, etc. Below the care room 30, a machine room 40 may be provided to supply hot and dry air to the care room 30.

In the cabinet 10, a flow path along which air circulates through the care room 30 and the machine room 40 may be provided.

The shoe supporter 50 capable of supporting shoes may be provided inside the care room 30. The shoe supporter 50 may be installed on one side surface of the care room 30. In FIGS. 2 and 3, the shoe supporter 50 is shown to be located on a right side of the care room 30. However, the location of the shoe supporter 50 is not limited to this, and the shoe supporter 50 may be located on a left side of the care room 30 or on a rear inner side of the care room 30. The shoe supporter 50 may be detachable from the cabinet 10. At least one shoe supporter 50 may be provided. The shoe supporter 50 may have a shape of being insertable into the inside of a shoe.

In the care room 30, a supporter rail 51 for supporting the shoe supporter 50 may be provided. The shoe supporter 50 may be detachably attached to the supporter rail 51. The supporter rail 51 may be provided on one side of the internal case 12. The supporter rail 51 may be positioned to correspond to a supply opening 60 provided in one side of the internal case 12.

The supporter rail 51 may include a rail opening 51*a* that is communicable with the supply opening 60. The rail opening 51*a* may penetrate a body of the supporter rail 51. The rail opening 51*a* may be opened or closed by a supply door 56 provided at the supply opening 60.

The shoe supporter 50 and the supporter rail 51 may be located on one side of the cabinet 10 to communicate with the supply opening 60. The shoe supporter 50 may be connected to a supply duct 70 by communicating with the supply opening 60. For example, the shoe supporter 50 may be located on a right side surface of the care room 30, although not limited thereto. However, the shoe supporter 50 may be located on a left side surface of the care room 30.

Because the shoe supporter 50 is detachable from the care room 30, a space of the care room 30 for caring relatively long shoes may be secured.

In the cabinet 10, the machine room 40 includes equipment for dehumidifying or heating inside air of the care room 30. The machine room 40 may be located below the cabinet 10. The machine room 40 may be provided below the care room 30. In the machine room 40, equipment including a heat exchanger 47 for exchanging heat with air entered the machine room 40 may be positioned to supply hot and dry air to the inside of the care room 30.

The machine room 40 may include an inlet 49*a* through which air enters the machine room 40 from the care room 30, and an outlet 49*b* through which air is discharged to the care room 30. Air entered through the inlet 49*a* may be humid air. Air discharged through the outlet 49*b* may be hot and dry air.

The inlet 49*a* of the machine room 40 may communicate with a recovery chamber 80. The outlet 49*b* of the machine room 40 may communicate with the supply duct 70 which will be described below. Also, at the inlet 49*a* of the machine room 40, a filter unit may be positioned. The filter unit may filter foreign materials from air which will enter the machine room 40. That is, the filter unit may prevent foreign materials from entering the machine room 40. For example, the filter unit may be configured with a filter frame 39 and a filter 38 installed in the filter frame 39.

In a lower portion of the cabinet 10, a drain fan 48 that is detachable from the cabinet 10 may be installed. The drain fan 48 may be adjacent to the heat exchanger 47 to easily collect condensed water generated by the heat exchanger 47 (specifically, a condenser 43).

The heat exchanger 47 may be provided to dehumidify and/or heat inside air of the machine room 40 as necessary. The heat exchanger 47 may heat air collected from the care room 30 and supply hot and dry air to the care room 30. The heat exchanger 47 may include an evaporator 42 and the condenser 43 through which a refrigerant circulates. The heat exchanger 47 may dehumidify and/or heat air.

In the machine room 40, a refrigerant cycle may be formed. The refrigerant cycle may be formed by a refrigerant circulating through a compressor 41, the evaporator 42, an expansion valve (not shown), and the condenser 43. The evaporator 42 may evaporate a refrigerant expanded by the expansion valve (not shown) to thereby dehumidify air entered the machine room 40. Also, the condenser 43 may condense a refrigerant compressed by the compressor 41 to thereby heat air passed through the evaporator 42. Accordingly, air passed through the heat exchanger 47 may become a hot and dry state.

A blow fan 44 may cause air to smoothly enter the machine room 40 and be smoothly discharged from the machine room 40. The blow fan 44 may be a centrifugal fan that inhales air in a direction of a rotation shaft and discharges air in a radial direction. However, a kind of the blow fan 44 is not limited to a centrifugal fan, and the blow fan 44 may be provided as an axial flow fan or a mixed flow fan.

In the machine room 40, a connection flow path 82 along which air passing through the evaporator 42, the condenser 43, and the blow fan 44 flows may be formed. The connection flow path 82 may be formed by a connection duct 46. One end of the connection duct 46 may communicate with the care room 30. The other end of the connection duct 46 may communicate with the supply duct 70 provided in one side wall of the cabinet 10. The connection duct 46 may cover at least one portion of the evaporator 42, the condenser 43, and the blow fan 44.

The recovery chamber 80 may be provided between the care room 30 and the machine room 40. The recovery chamber 80 may be a space partitioned from the care room 30, and guide air collected from the care room 30 to the machine room 40. More specifically, the recovery chamber 80 may guide air collected from the care room 30 to the inlet 49*a* of the machine room 40. One end of the recovery chamber 80 may communicate with the care room 30, and the other end of the recovery chamber 80 may communicate with the machine room 40. In the recovery chamber 80, a recovery flow path 81 along which air flows from the care room 30 to the machine room 40 may be formed.

The recovery chamber 80 may be formed by a separation shelf 91 which will be described below. For example, the recovery chamber 80 may be a space partitioned in an up-down direction from the care room 30 by installing the separation shelf 91 in the internal case 12.

In the care room 30, the supply opening 60 may be provided. The supply opening 60 may be located in the side wall of the internal case 12. More specifically, the supply opening 60 may be formed in the left side surface of the care room 30 in which the shoe supporter 50 is located. However, the location of the supply opening 60 is not limited to this, and the supply opening 60 may be formed in the right side surface of the care room 30 to correspond to the location of the shoe supporter 50. At least one supply opening 60 may be formed. The supply opening 60 may supply hot and dry air passed through the heat exchanger 47 of the machine room 40 to the inside of the care room 30 to dry and/or dehumidify shoes. The supply opening 60 may be substantially in a shape of a circle, although not limited thereto. The supply opening 60 may have various shapes, such as a quadrangle, a polygon, etc.

The connection duct 46 may connect the supply duct 70 to the recovery chamber 80. One end of the connection duct 46 may communicate with the supply duct 70. At the other end of the connection duct 46, the inlet 49*a* of the machine room 40 may be provided. The other end of the connection duct 46 may communicate with the recovery chamber 80. Air entered the machine room 40 through a grille 92 of the separation shelf 91 may pass through the connection duct 46 to be dehumidified and/or heated, and then be again discharged to the care room 30 through the supply duct 70 and the supply opening 60. Thereby, shoes, clothes, etc. accommodated inside the care room 30 may be cared (for example, dried, dehumidified, or sterilized) by hot and dry air discharged through the supply opening 60.

The supply duct 70 may extend in the up-down direction between the external case 11 and the internal case 12 of the cabinet 10. The supply duct 70 may be positioned in the side of the cabinet 10 on which the shoe supporter 50 is mounted. One end of the supply duct 70 may communicate with the connection duct 46, and the other end of the supply duct 70 may communicate with the supply opening 60. The supply duct 70 may form a supply flow path 83 for guiding air discharged from the machine room 40 to the supply opening 60.

The shoe care apparatus 1 may further include a water supply container (not shown), a steam generator (not shown) configured to receive water from the water supply container and generate a steam, and a steam spray (not shown) configured to receive a steam from the steam generator and spray the steam to the care room 30.

The water supply container may be positioned below the care room 30. Water stored in the water supply container may be supplied to the steam generator and used to form a steam. The water supply container may be detachable from the cabinet 10 to easily add water.

The steam generator may be positioned in the machine room 40. The steam generator may generate a steam and guide the steam to the steam spray. The steam generator may be connected to the steam spray through a steam supply pipe (not shown).

The shoe care apparatus 1 may further include a deodorizing device 45. The deodorizing device 45 may be positioned inside the machine room 40. The deodorizing device 45 may be positioned in the connection duct 46 to remove smell of air passing through the care room 30. In FIG. 3, the deodorizing device 45 is shown to be positioned to the left of the blow fan 44. However, the location of the deodorizing device 45 is not limited to this, and the deodorizing device 45 may be positioned to the right of the blow fan 44.

The deodorizing device 45 may include a deodorizing filter 45*a* and a sterilizing lamp 45*b*. The deodorizing filter 45*a* may include a ceramic filter. The sterilizing lamp 45*b* may include an ultraviolet lamp, although not limited thereto. However, the deodorizing filter 45*a* may include various filters that are capable of removing smell of air. The sterilizing lamp 45*b* may include various devices that are capable of removing germs.

In the care room 30, at least one shelf 90 may be provided. The shelf 90 may hold an object thereon. The supply opening 60 and the shoe supporter 50 may be positioned adjacent to the shelf 90.

The shelf 90 may include a duct shelf 95. The duct shelf 95 may include an internal flow path 96 as shown in FIG. 3. Heated air (or hot and dry air) passing through the internal flow path 96 may be sprayed toward an object from each of a spray port 95*a* of the duct shelf 95 and a spray port 97*a* of a circular duct 97. Also, the heated air may pass through the internal flow path 96 and be discharged to the care room 30 through a shelf outlet 98. In FIG. 3, the shelf outlet 98 is shown to be positioned in an upper side of the duct shelf 95, although not limited thereto. However, the shelf outlet 98 may be positioned in a lower side of the duct shelf 95.

The shelf 90 may include a separation shelf 91. The separation shelf 91 may form the recovery chamber 80. For example, the separation shelf 91 may be installed in the internal case 12 to form the recovery chamber 80 partitioned from the care room 30.

The separation shelf 91 may be detachably installed in the cabinet 10. That is, the separation shelf 91 may be detachably attached to the cabinet 10. Also, to easily attach/detach the separation shelf 91 to/from the cabinet 10, a handle (not shown) may be provided at both sides of the separation shelf 91.

In a front portion of the separation shelf 91, a grille 92 for collecting inside air of the care room 30 may be formed. The grille 92 may form a recovery opening (not shown) for communicating the care room 30 with the recovery chamber 80.

The shoe care apparatus 1 may include at least one sensor 13. The sensor 13 may sense inside smell of the care room 30. The shoe care apparatus 1 may display state information of the smell sensed by the sensor 13. More specifically, the control panel 170 provided in the door 100 may display state information of smell sensed by the sensor 13. Accordingly, a user may easily check state information of smell with his/her naked eyes through the control panel 170 without opening the door 100.

The sensor 13 may be installed in the care room 30 and/or the shelf 90, although not limited thereto. The sensor 13 may be installed at any location at which the sensor 13 is capable of sensing inside smell of the care room 30.

Figure 4:
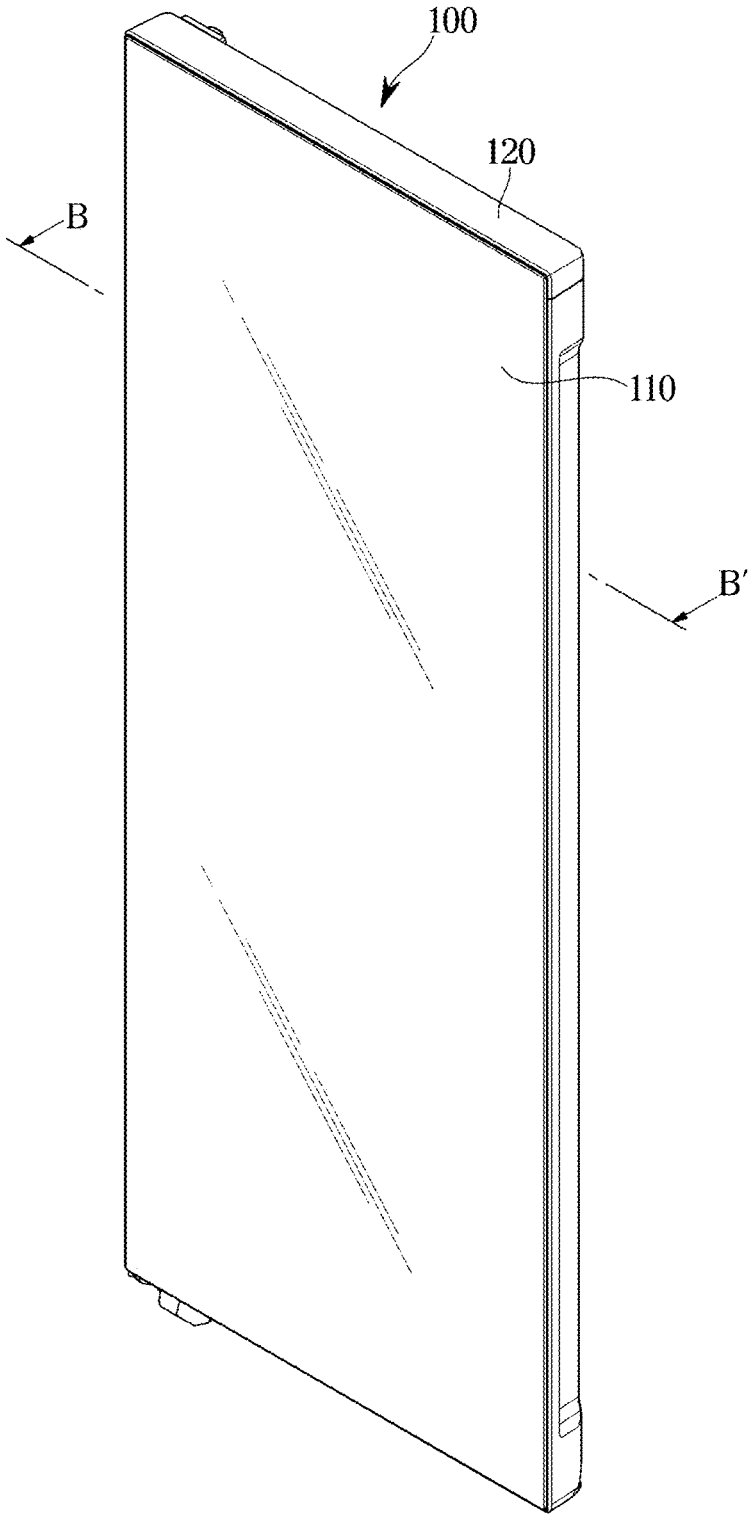
FIG. 4 illustrates a door coupled with a first door cover, in a shoe care apparatus according to an embodiment of the disclosure.
Figure 5:
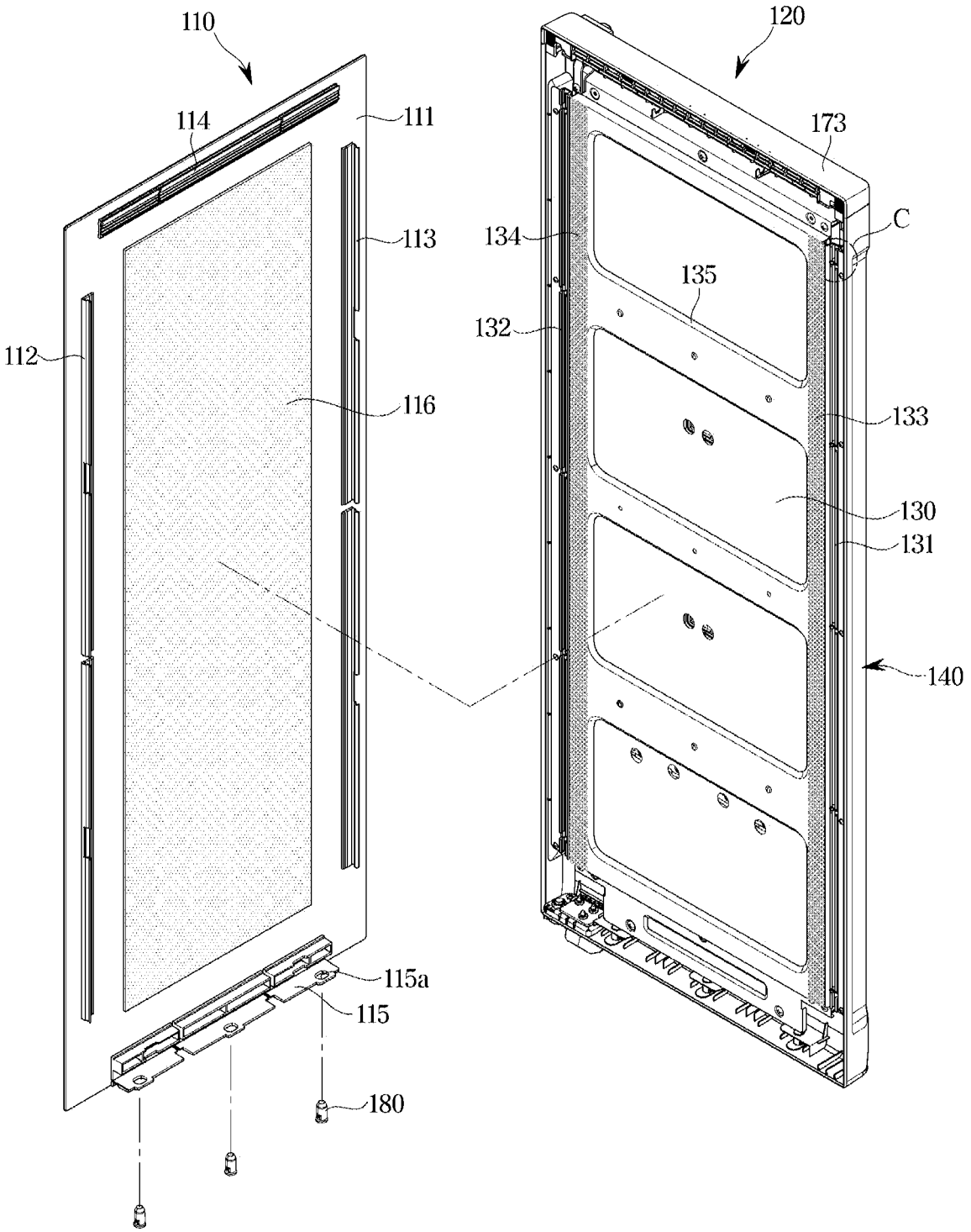
FIG. 5 illustrates the door shown in FIG. 4 separated into a door cover and a door body.

FIG. 4 illustrates a door coupled with a first door cover, in a shoe care apparatus according to an embodiment of the disclosure. FIG. 5 illustrates an exploded perspective view of a door cover and a door body of the door shown in FIG. 4.

Referring to FIGS. 4 and 5, in the shoe care apparatus 1 according to an embodiment of the disclosure, the door 100 may be separated into a door cover 110 and the door body 120.

The door body 120 may be rotatably coupled with the cabinet 10. The door body 120 may form a rear surface of the door 100, and the door cover 110 may be detachably coupled with the door body 120.

Figure 9:
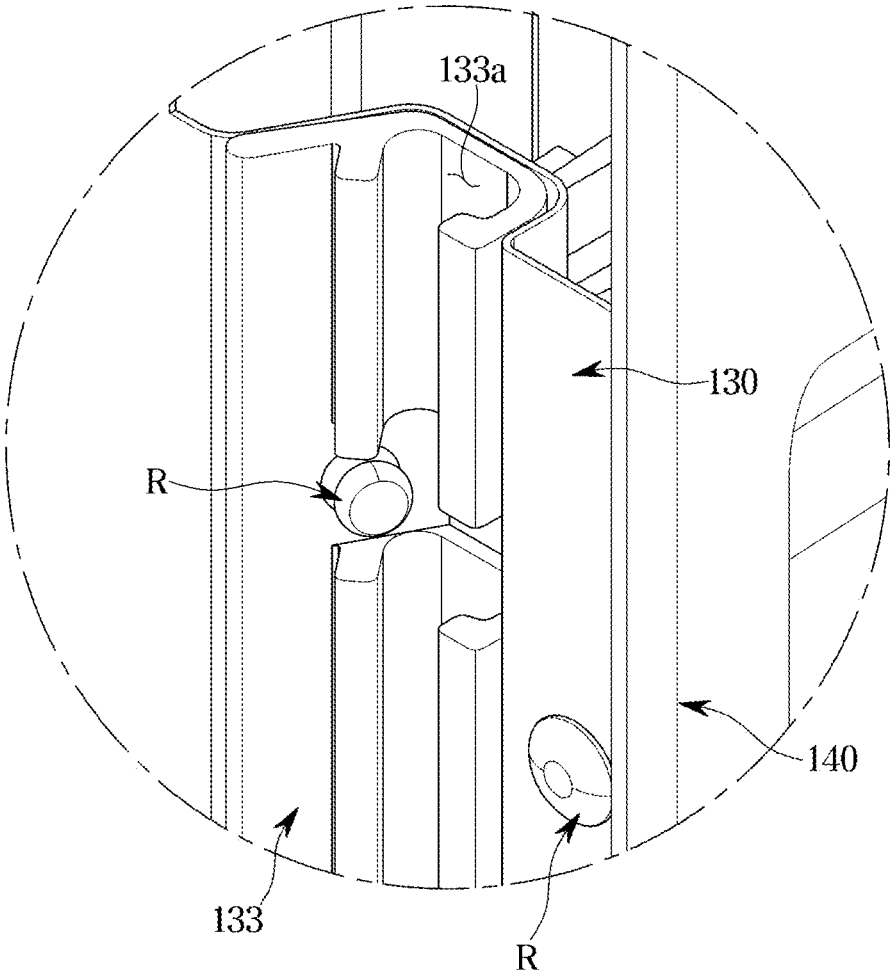
FIG. 9 illustrates an enlarged view of a part C shown in FIG. 5.
Figure 10:
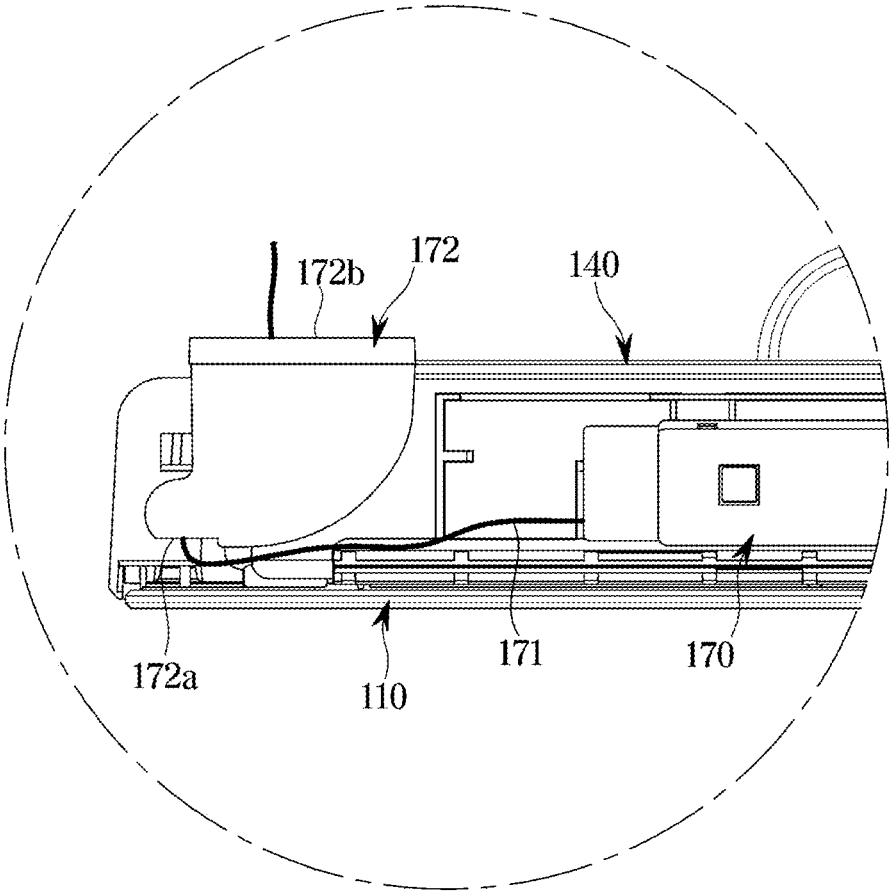
FIG. 10 illustrates a top view of a top cover separated from the door shown in FIG. 4.
Figure 11:
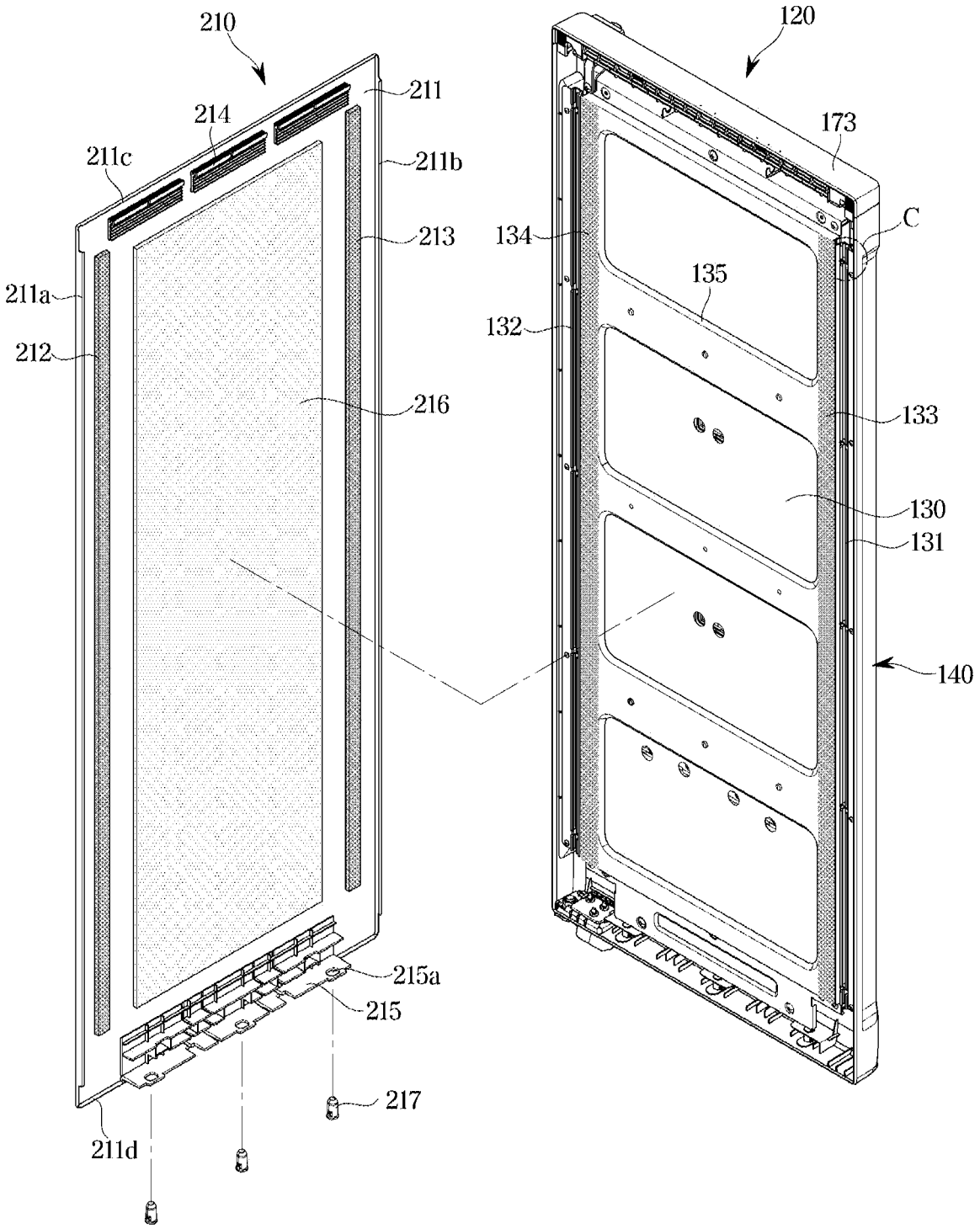
FIG. 11 illustrates a door to which a second door cover is coupled separated into the second door cover and a door body, in a shoe care apparatus according to an embodiment of the disclosure.

Hereinafter, the door cover 110 shown in FIGS. 5 to 10 is referred to as a first door cover 110, and a door cover 210 shown in FIG. 11 is referred to as a second door cover 210.

The first door cover 110 may be detachably coupled with the door body 120. The first door cover 110 may be coupled with the door body 120 to cover a front surface of the door body 120. The first door cover 110 may form an outer appearance of the door 100.

The first door cover 110 may include a first front panel 111. The first front panel 111 may be provided with various colors and/or designs, and a user may select the first front panel 111 according to his/her taste. The first front panel 111 may include a glass material. The first front panel 111 may be provided in a shape of a plate.

The first door cover 110 may include side trims 112 and 113, an upper trim 114, and a lower trim 115, which are provided on a rear surface of the first front panel 111. Also, the first door cover 110 may further include a buffer member 116 provided on the rear surface of the first door cover 110.

The side trims 112 and 113 may include a first side trim 112 and a second side trim 113. The first side trim 112 and the second side trim 113 may have the same structure and be symmetrically arranged. According to an embodiment of the disclosure, the side trims 112 and 113 may be provided as rigid bodies with little structural deformation, and recess portions 131 and 132 which will be described below may be provided as flexible materials with elastic deformation, although not limited thereto. However, the side trims 112 and 113 may be provided as flexible materials, and the recess portions 131 and 132 may be provided as rigid bodies.

The side trims 112 and 113 may be inserted in coupling grooves of the recess portions 131 and 132 which will be described below. By inserting at least one portion of the side trims 112 and 113 into the coupling grooves of the recess portions 131 and 132, the side trims 112 and 113 may be coupled with the recess portions 131 and 132.

The upper trim 114 may be positioned at an upper edge of the rear surface of the first front panel 111. The upper trim 114 may be coupled with an upper trim coupling portion (a reference numeral is omitted) of the door body 120. The upper trim 114 may be coupled with the upper trim coupling portion while rotating on the upper trim coupling portion as a rotation shaft.

The lower trim 115 may be positioned at a lower edge of the rear surface of the first front panel 111. The lower trim 115 may be coupled with a lower trim coupling portion (a reference numeral is omitted) of the door body 120. After the upper trim 114 is coupled with the upper trim coupling portion, the first door cover 110 may move toward the door body 120 and the lower trim 115 may be coupled with the lower trim coupling portion.

After the lower trim 115 is coupled with the lower trim coupling portion, a fixing member 180 may be coupled with a lower surface of the door 100 such that the first door cover 110 is not separated from the door body 120. At least one portion of the fixing member 180 may pass through a hole (not shown) formed in the lower surface of the door body 120 and a fixing member hole 115*a* formed in the lower trim 115 to couple the first door cover 110 with the door body 120. By coupling the fixing member 180 with the lower surface of the door 100, the first door cover 110 may be not separated from the door body 120.

The buffer member 116 may be positioned in a space formed between the first front panel 111 and the door body 120. The buffer member 116 may prevent an impact applied to the first front panel 111 from being transferred to the door body 120. Also, the buffer member 116 may absorb noise that may be generated in the first door cover 110. The buffer member 116 may include expanded polystyrene.

Figure 6:
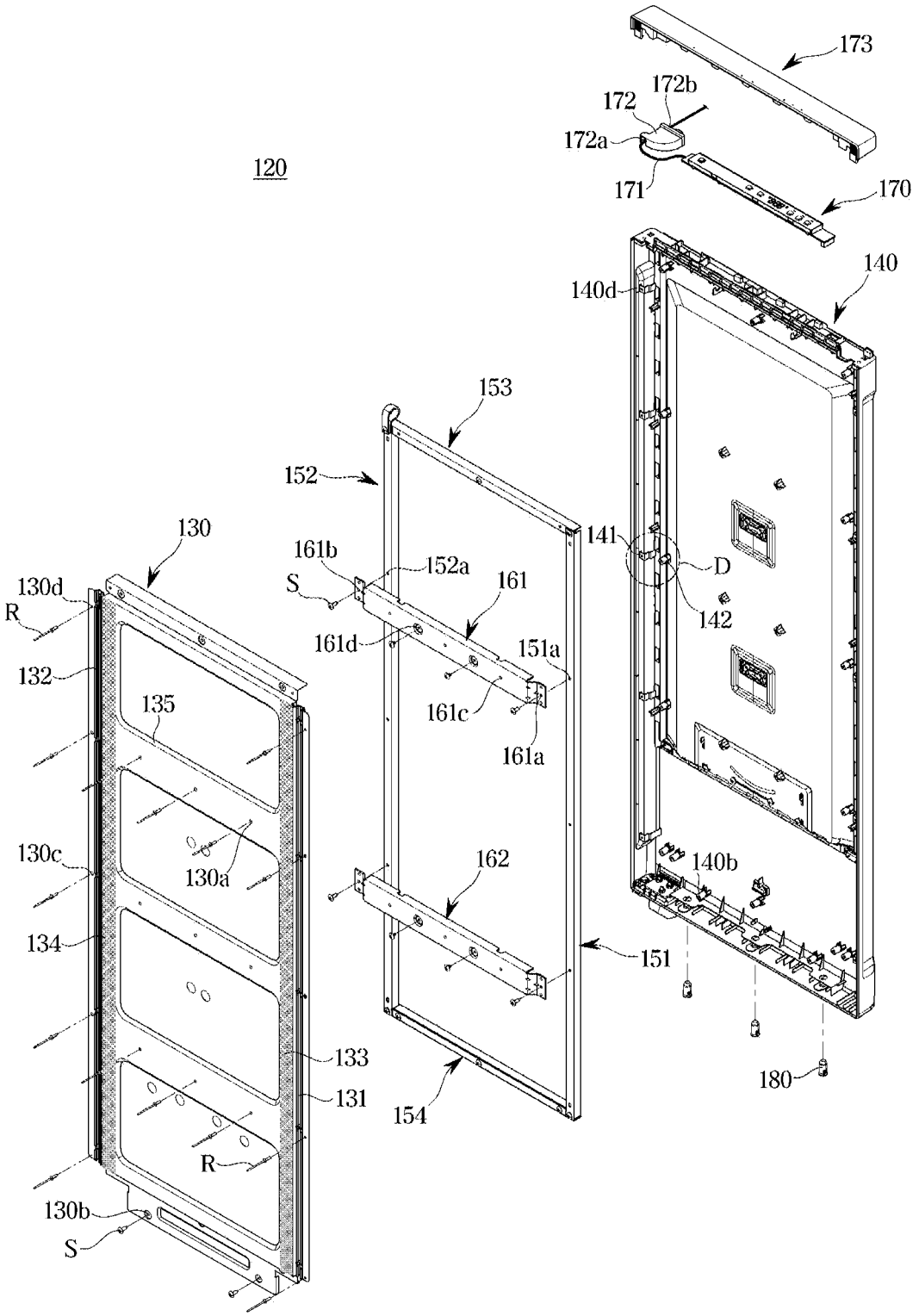
FIG. 6 illustrates an exploded perspective view of a door body in a shoe care apparatus according to an embodiment of the disclosure.

FIG. 6 illustrates an exploded perspective view of a door body in a shoe care apparatus according to an embodiment of the disclosure.

Hereinafter, a configuration of the door body 120 in the shoe care apparatus 1 according to an embodiment of the disclosure will be described in detail with reference to FIG. 6.

According to an embodiment of the disclosure, the door body 120 may include a rear body 140 forming the rear surface of the door 100, a reinforcement plate 130 coupled with the rear body 140 to reinforce strength of the rear body 140, and a plurality of brackets 151, 152, 153, 154, 161, and 162 positioned between the rear body 140 and the reinforcement plate 130 to reinforce the strength of the rear body 140.

Also, the door body 120 may further include a control panel 170 embedded into an upper portion of the rear body 140, a wire 171 electrically connecting the control panel 170 to inside of the cabinet 10, and a wire guide 172 guiding the wire 171. Also, the door body 120 may further include a top cover 173 coupled with an upper side of the rear body 140 to cover the control panel 170, the wire 171, and the wire guide 172. The control panel 170, the wire 171, and the wire guide 172 may be positioned in a space formed between the top cover 173 and an upper surface of the rear body 140.

The rear body 140 may be formed by injection-molding. Accordingly, the rear body 140 may be made of a nonmetal material. The rear body 140 may include a rivet coupling portion 141 with which a rivet R is coupled, and a screw coupling portion 142 with which a screw S is coupled. The rivet coupling portion 141 and the screw coupling portion 142 may be integrated into the rear body 140. Also, a plurality of rivet coupling portions 141 may be provided, and a plurality of screw coupling portions 142 may be provided.

The reinforcement plate 130 may be coupled with the rear body 140 to cover a front surface of the rear body 140. The reinforcement plate 130 may reinforce the strength of the rear body 140 manufactured by injection-molding. The reinforcement plate 130 may be made of a metal material, or include a magnetic body. The reinforcement plate 130 may include a depressed portion 135 for reinforcing the strength of the reinforcement plate 130. The depressed portion 135 may be formed by depressing a portion of the reinforcement plate 130 toward the rear body 140, and a plurality of depressed portions 135 may be provided.

The reinforcement plate 130 may include a plurality of holes 130*a*, 130*b*, 130*c*, and 130*d* into which the rivet R or the screw S is inserted. The reinforcement plate 130 may include the recess portions 131 and 132. Also, the reinforcement plate 130 may include magnet coupling portions 133 and 134 arranged in parallel to the recess portions 131 and 132. The magnet coupling portions 133 and 134 do not indicate separate components, and may indicate some areas of the reinforcement plate 130. More specifically, the magnet coupling portions 133 and 134 may indicate areas being adjacent to the recess portions 131 and 132. The magnet coupling portions 133 and 134 may be coupled with magnets 212 and 213 which will be described below by a magnetic force, and may indicate the reinforcement plate 130 at locations corresponding to the magnets 212 and 213.

A pair of recess portions 131 and 132 may be provided. A pair of magnet coupling portions 133 and 134 may be provided. The pair of recess portions 131 and 132 and the pair of magnet coupling portions 133 and 134 may extend in the up-down direction, and may be arranged adjacent to both sides of the reinforcement plate 130. Also, the pair of magnet coupling portions 133 and 134 may be positioned between the pair of recess portions 131 and 132.

The brackets 151, 152, 153, 154, 161, and 162 may be coupled with the rear body 140 to reinforce the strength of the rear body 140. Also, the brackets 151, 152, 153, 154, 161, and 162 may be coupled with the rear body 140 and the reinforcement plate 130 to mediate coupling between the rear body 140 and the reinforcement plate 130.

The brackets 151, 152, 153, 154, 161, and 162 may include first brackets 151 and 152 extending in the up-down direction and coupled with both sides of the rear body 140, second brackets 153 and 154 extending in the left-right direction and coupled with upper and lower sides of the rear body 140, and connection brackets 161 and 162 connecting the first brackets 151 and 152.

The first brackets 151 and 152 may have the same structure. The first brackets 151 and 152 may include holes 151*a* and 152*a* into which screws S are inserted. The first brackets 151 and 152 and the reinforcement plate 130 may be coupled with the rear body 140 by screws S.

The second brackets 153 and 154 may have the same structure. Both ends of the second brackets 153 and 154 may be coupled with both ends of the first brackets 151 and 152 by screws S. The second brackets 153 and 154 and the reinforcement plate 130 may be coupled with the rear body 140 by screws S.

The connection brackets 161 and 162 may have the same structure. The connection brackets 161 and 162 may include screw holes 161*a*, 161*b*, and 161*d* into which screws S are inserted, and rivet holes 161*c* into which rivets R are inserted. The connection brackets 161 and 162 may be coupled with the reinforcement plate 130 by the rivets R. Also, the connection brackets 161 and 162 may be coupled with the rear body 140 by screws S.

In the reinforcement plate 130, the brackets 151, 152, 153, 154, 161, and 162, and the rear body 140, a plurality of holes may be formed. Hereinafter, coupling of the reinforcement plate 130, the brackets 151, 152, 153, 154, 161, and 162, and the rear body 140 will be described by using some of the holes as an example.

The first holes 130*a* of the reinforcement plate 130 may be positioned at locations corresponding to the rivet holes 161*c* of the connection bracket 161. The reinforcement plate 130 may be coupled with the connection bracket 161 by passing the rivets R through the first holes 130*a* and the rivet holes 161*c* and then riveting the rivets R.

The second holes 130*b* of the reinforcement plate 130 may be positioned at locations corresponding to the lower holes 140*b* of the rear body 140. The reinforcement plate 130 may be coupled with the rear body 140 by passing screws S through the second holes 130*b* and the lower holes 140*b* and screw-coupling the screws S with the rear body 140.

The third holes 130*c* of the reinforcement plate 130 may be positioned at locations corresponding to the rivet coupling portions 141 of the rear body 140. The reinforcement plate 130 may be coupled with the rear body 140 by passing rivets R through the third holes 130*c* and the rivet holes 141*a* of the rivet coupling portion 141 and then riveting the rivets R. The rivet coupling portion 141 will be described below.

The fourth holes 130*d* of the reinforcement plate 130 may be coupled with the rivet holes 140*d* of the rear body 140 by the same method by which the third holes 130*c* are coupled with the rivet holes 141*a*, and accordingly, overlapping descriptions will be omitted.

Figure 7:
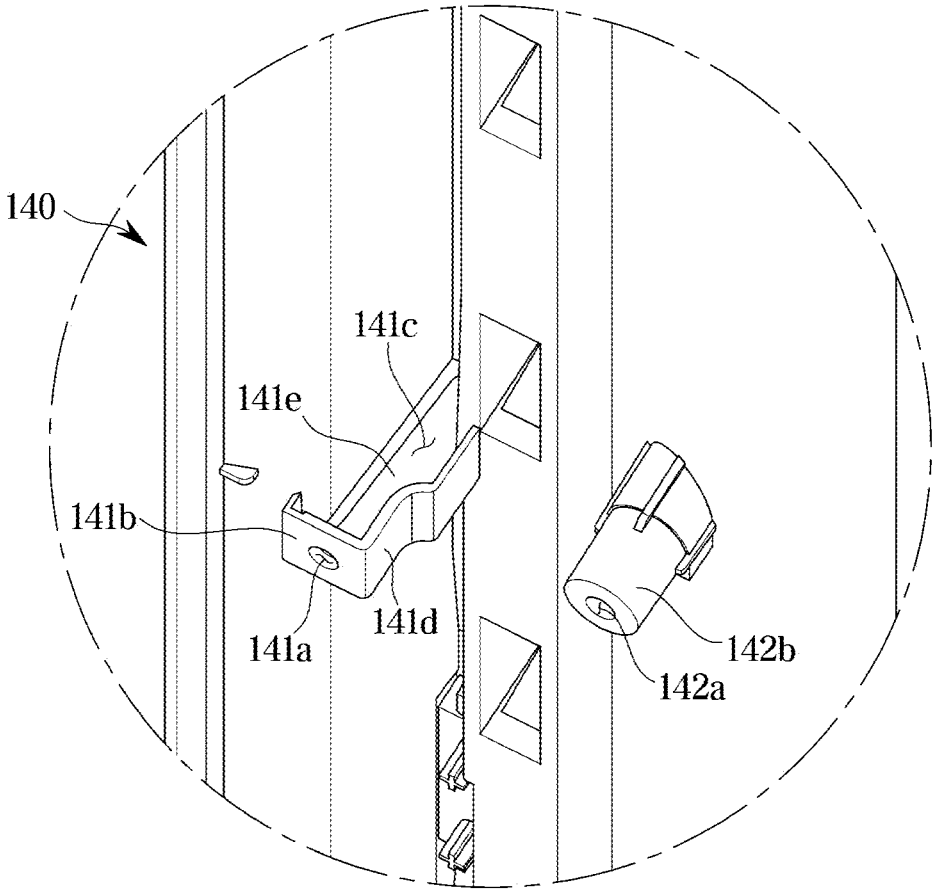
FIG. 7 illustrates an enlarged view of a part D shown in FIG. 6.

FIG. 7 illustrates an enlarged view of a part D shown in FIG. 6.

Hereinafter, the rivet coupling portion 141 according to an embodiment of the disclosure will be described in detail with reference to FIG. 7.

Referring to FIG. 7, the rear body 140 may be coupled with rivets R, and include the rivet coupling portion 141 integrated into the rear body 140.

The rivet coupling portion 141 may include a rivet hole 141*a* through which a rivet R passes, a rivet support plate 141*b* in which the rivet hole 141*a* is formed, and an accommodating space 141*c* accommodating a portion of the rivet R passed through the rivet hole 141*a*.

A diameter of the rivet hole 141*a* may be greater than that of a shaft of the rivet R such that the shaft of the rivet R passes through the rivet hole 141*a*. The diameter of the rivet hole 141*a* may be smaller than that of a head of the rivet R such that the head of the rivet R does not pass through the rivet hole 141*a*. The rivet hole 141*a* may penetrate the rivet support plate 141*b*.

The rivet support plate 141*b* may face the reinforcement plate 130. A front surface of the rivet support plate 141*b* may be in contact with the reinforcement plate 130.

The rivet coupling portion 141 may include the accommodating space 141*c* accommodating the rivet R. A side of the accommodating space 141*c* may open. The rivet coupling portion 141 may include the rivet support plate 141*b*, and connection plates 141*d* and 141*e* connecting the rivet support plate 141*b* to the rear body 140. The accommodating space 141*c* may be formed by the rivet support plate 141*b*, the connection plates 141*d* and 141*e*, and the rear body 140.

An upper side of the accommodating space 141*c* may open as seen in FIG. 7. In other words, the connection plates 141*d* and 141*e* of the rivet coupling portion 141 may not exist in the upper side of the accommodating space 141*c*. A direction of the upper side of the accommodating space 141*c* may be defined as seen in FIG. 7.

Because one side of the accommodating space 141*c* opens, slide equipment may be taken out through the open side of the accommodating space 141*c* upon injection-molding. As described above, the rear body 140 may be manufactured by injection-molding, and slide equipment may be used for a reason such as undercut upon injection-molding. To take slide equipment out, a space through which the slide equipment is taken out may be used. According to an embodiment of the disclosure, upon injection-molding of the rear body 140, slide equipment may be taken out through the open side of the accommodating space 141*c*.

According to a concept of the disclosure, the rear body 140 manufactured by injection-molding may be coupled with the reinforcement plate 130 manufactured by pressing a metal plate by rivets.

In a case in which the rear body 140 is an injection-molding product being not a metal material, the rear body 140 may have weak strength, and accordingly, the rear body 140 may be reinforced. To reinforce the strength of the rear body 140, the reinforcement plate 130 may be coupled with the rear body 140. There may be various methods for coupling the reinforcement plate 130 with the rear body 140, however, rivet coupling may be used as a method for reducing material cost and investment cost, improving utilization of space of the rear body 140, and simplifying an assembly process.

The rivet coupling may have advantages of low material cost, low process investment cost, and a simple assembly process, compared with a process using foam treatment and application of an adhesive.

Also, screw coupling may have low utilization of space because the head of a screw occupies a larger space than that of a rivet, and an outer appearance of the rear body 140 may be contracted by a boss portion used for screw coupling, which may deteriorate quality of the outer appearance.

According to a concept of the disclosure, because the rear body 140 is coupled with the reinforcement plate 130 by rivets, the door 100 capable of reducing material cost and process investment cost, simplifying an assembly process, and improving utilization of space and quality of the outer appearance may be provided.

According to a concept of the disclosure, to couple the rear body 140 with the reinforcement plate 130 by rivets, the rear body 140 may include the rivet coupling portion 141. The rivet coupling portion 141 and the rear body 140 may be integrated into one body by injection-molding. The rivet coupling portion 141 may include the accommodating space 141*c* in which a rivet R is accommodated, and one side of the accommodating space 141*c* may open.

Figure 8:
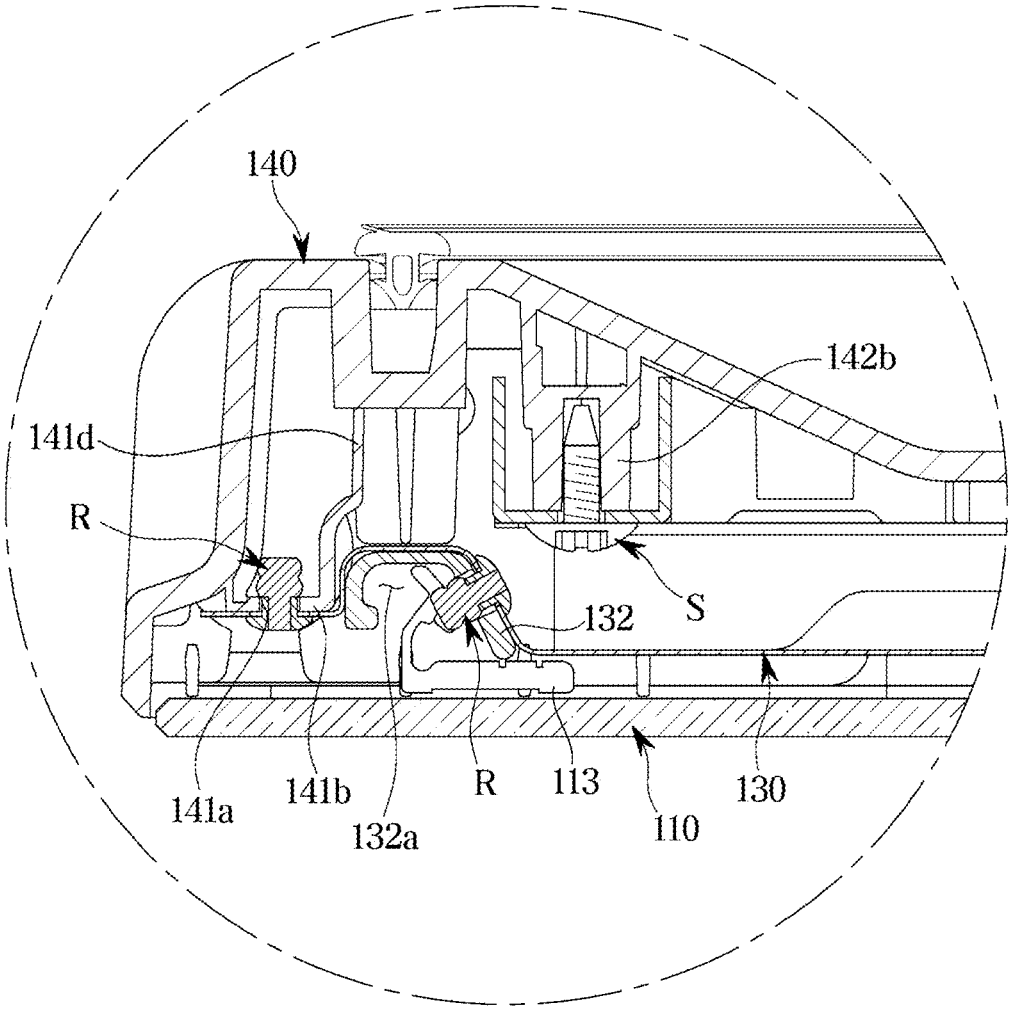
FIG. 8 illustrates a part of a cross section taken along line B-B' of FIG. 4.

FIG. 8 illustrates a part of a cross section taken along line B-B' of FIG. 4. FIG. 9 illustrates an enlarged view of a part C shown in FIG. 5.

Referring to FIG. 8, as described above, the rear body 140 may be coupled with the reinforcement plate 130 by rivets R.

Referring to FIGS. 8 and 9, the recess portion 132 may be coupled with the reinforcement plate 130 by a rivet R. The side trim 113 of the first door cover 110 may be inserted into a coupling groove 132*a* of the recess portion 132. Upon inserting of the side trim 113 into the coupling groove 132*a*, the recess portion 132 made of a flexible material may be elastically deformed.

FIG. 10 illustrates a top view of a top cover separated from the door shown in FIG. 4.

Referring to FIG. 10, in the shoe care apparatus 1 according to an embodiment of the disclosure, the control panel 170 may be embedded into an upper portion of the door body 120. In the upper portion of the rear body 140, a preset space may be provided. The control panel 170 may be positioned in the preset space.

The wire 171 electrically connecting the control panel 170 to the inside of the cabinet 10 may extend from the control panel 170 to the inside of the cabinet 10.

The wire guide 172 may be coupled with one side of the upper portion of the rear body 140 to cover the hinge 102 of the door 100. The wire guide 172 may include a wire entrance 172*a* and a wire exit 172*b*. The wire 171 extending from the control panel 170 may enter the inside of the wire guide 172 through the wire entrance 172*a*. The wire 171 entered the inside of the wire guide 172 may exit the wire guide 172 through the wire exit 172*b*. Also, the wire 171 exited the wire guide 172 through the wire exit 172*b* may extend to the inside of the cabinet 10.

The wire entrance 172*a* may be formed at one side of the wire guide 172. The wire entrance 172*a* may be formed by cutting a portion of one side of the wire guide 172 or may be provided in a shape of a hole at one side of the wire guide 172.

The wire exit 172*b* may be formed at the other side of the wire guide 172. The wire exit 172*b* may be formed by cutting a portion of the other side of the wire guide 172 or may be provided in a shape of a hole at the other side of the wire guide 172.

The wire guide 172 may be coupled with the upper portion of the rear body 140 to guide and cover the wire 171, and cover the hinge 102.

The top cover 173 may be coupled with the upper surface of the rear body 140. The control panel 170, the wire 171, and the wire guide 172 may be accommodated between the top surface of the rear body 140 and the top cover 173.

FIG. 11 illustrates an exploded perspective view of a door coupled with a second door cover, in a shoe care apparatus according to an embodiment of the disclosure.

Referring to FIG. 11, the second door cover 210 will be described. A door body 120 of FIG. 11 is the same as the door body 120 described above, and therefore, overlapping descriptions will be omitted.

The second door cover 210 may include a second front panel 211. The second front panel 211 may be made of a material that is different from that of the first front panel 111. The second front panel 211 may be provided with various colors and/or designs, and a user may select the second front panel 211 according to his/her taste. The second front panel 211 may include a metal material.

The second front panel 211 may include bending portions 211*a*, 211*b*, 211*c*, and 211*d* bent backward at its four sides.

On a rear surface of the second front panel 211, magnets 212 and 213, an upper trim 214, and a lower trim 215 may be provided. Also, on the rear surface of the second front panel 211, a buffer member 216 may be provided.

The upper trim 214, the lower trim 215, and the buffer member 216 may have the same structures as or similar structures to the upper trim 114, the lower trim 115, and the buffer member 116 described above, and perform the same functions as those of the upper trim 114, the lower trim 115, and the buffer member 116. A fixing member 217 may be the same as the fixing member 180 described above.

The second door cover 210 may include the magnets 212 and 213 provided on the rear surface. The magnets 212 and 213 may include a first magnet 212 and a second magnet 213. The first magnet 212 and the second magnet 213 may be arranged adjacent to both sides of the second front panel 211, and extend in the up-down direction.

The first magnet 212 and the second magnet 213 may be coupled with a first magnet coupling portion 133 and a second magnet coupling portion 134 of the reinforcement plate 130 by a magnetic force. As described above, the first magnet coupling portion 133 and the second magnet coupling portion 134 may indicate some portions of the reinforcement plate 130. More specifically, the first magnet coupling portion 133 and the second magnet coupling portion 134 may indicate some areas of the reinforcement plate 130, being adjacent to the recess portions 131 and 132. The recess portions 131 and 132 may be positioned between the magnet coupling portions 133 and 134. In the drawings, for convenience of description, the first magnet coupling portion 133 and the second magnet coupling portion 134 are shaded, however, the first magnet coupling portion 133 and the second magnet coupling portion 134 may be not shaded.

According to a concept of the disclosure, the door body 120 may configure the door 100 by being selectively coupled with the first door cover 110 or the second door cover 210. In other words, any one of the first door cover 110 and the second door cover 210 may be coupled with the door body 120. The door body 120 may include the recess portions 131 and 132 to be coupled with the first door cover 110, and also, the door body 120 may include the magnet coupling portions 133 and 134 to be coupled with the second door cover 210. Accordingly, the first door cover 110 or the second door cover 210 may be coupled with the door body 120 without changing the structure of the door body 120.

According to a concept of the disclosure, the shoe care apparatus includes a door that is capable of simplifying an assembly process while reducing material cost may be provided.

According to a concept of the disclosure, the shoe care apparatus is capable of easily changing the design of the door may be provided.

According to a concept of the disclosure, the shoe care apparatus includes a door that couples the rear body provided as an injection mold with the cover plate provided as a metal material by using a rivet may be provided.

So far, specific embodiments have been shown and described. However, the disclosure is not limited to the above-described embodiments, and various modifications can be made by those skilled in the art without departing from the gist of the technical idea of the disclosure defined by the claims below.

Although the present disclosure has been described with various embodiments, various changes and modifications may be suggested to one skilled in the art. It is intended that the present disclosure encompass such changes and modifications as fall within the scope of the appended claims.

What is claimed is:

1. A shoe care apparatus comprising:

a main body;

a care room provided inside the main body and configured to accommodate shoes; and a door configured to open and close the care room, wherein the door comprises:

a front panel forming a front surface of the door, and including a side trim provided on a rear surface of the front panel or a magnet provided on the rear surface of the front panel;

a rear body forming a rear surface of the door; and a reinforcement plate positioned between the front panel and the rear body, and detachably coupled with the front panel, and the reinforcement plate comprises:

a recess portion configured to accommodate at least one portion of the side trim; and a magnet coupling portion coupled with the magnet by a magnetic force of the magnet, and arranged in parallel to the recess portion.

2. The shoe care apparatus of claim 1, wherein the door comprises:

a first door cover including the side trim and a first front panel including a first material; or a second door cover including the magnet and a second front panel including a second material that is different from the first material.

3. The shoe care apparatus of claim 1, wherein the door comprises:

a bracket positioned between the reinforcement plate and the rear body, and coupled with the rear body and the reinforcement plate, the bracket configured to couple the reinforcement plate with the rear body.

4. The shoe care apparatus of claim 3, wherein:

the reinforcement plate is coupled with the rear body by a first coupling member, and the bracket is coupled with the rear body by a second coupling member that is different from the first coupling member.

5. The shoe care apparatus of claim 4, wherein at least one of the first coupling member and the second coupling member includes a rivet.

6. The shoe care apparatus of claim 1, wherein the rear body further comprises a rivet coupling portion with which a rivet is coupled, wherein the rivet coupling portion and the rear body are integrated into one body.

7. The shoe care apparatus of claim 6, wherein the rivet coupling portion comprises:

a rivet hole through which the rivet passes; and a rivet support plate in which the rivet hole is formed, the rivet support plate facing the reinforcement plate.

8. The shoe care apparatus of claim 7, wherein the rivet coupling portion further comprises an accommodating space configured to accommodate the rivet that passed through the rivet hole, wherein one side of the accommodating space is configured to open.

9. The shoe care apparatus of claim 1, wherein:

the recess portion comprises a coupling groove in which at least one portion of the side trim is inserted, and the side trim is coupled with the recess portion when the side trim is inserted in the coupling groove.

10. The shoe care apparatus of claim 1, wherein:

the side trim comprises a pair of side trims, the magnet comprises a pair of magnets, the recess portion comprises a pair of recess portions each of which are configured to accommodate at least one portion of each of the pair of side trims, and the magnet coupling portion comprises a pair of magnet coupling portions coupled with the pair of magnets by a magnetic force.

11. The shoe care apparatus of claim 10, wherein the pair of magnet coupling portions are positioned between the pair of recess portions.

12. The shoe care apparatus of claim 1, wherein the door further comprises:

a control panel embedded into an upper portion of the door;

a wire extending from the control panel to inside of the main body; and a wire guide guiding the wire and covering a portion of the wire such that the wire passes a hinge of the door and extends inside of the main body.

13. The shoe care apparatus of claim 12, wherein the wire guide comprises:

a wire entrance formed at one side of the wire guide and configured to guide the wire extending from the control panel inside of the wire guide; and a wire exit formed at another side of the wire guide and configured to guide the wire inside of the wire guide to the inside of the main body.

14. The shoe care apparatus of claim 1, further comprising:

a supply duct supplying outside air of the care room to the care room;

a shoe supporter configured to support shoes, connected to the supply duct, and supplying inside air of the supply duct to the shoes; and a supporter holder supporting the shoe supporter disconnected from the supply duct, and positioned on the rear surface of the door.

* * * * *